US006167966B1

(12) United States Patent
Ayasse et al.

(10) Patent No.: US 6,167,966 B1
(45) Date of Patent: Jan. 2, 2001

(54) TOE-TO-HEEL OIL RECOVERY PROCESS

(75) Inventors: Conrad Ayasse; Alex Turta, both of Calgary (CA)

(73) Assignee: Alberta Research Council, Inc., Edmonton (CA)

( * ) Notice: Under 35 U.S.C. 154(b), the term of this patent shall be extended for 0 days.

(21) Appl. No.: 09/148,682

(22) Filed: Sep. 4, 1998

(51) Int. Cl.[7] ..... E21B 43/20
(52) U.S. Cl. ..... 166/268; 166/50
(58) Field of Search ..... 166/268, 50, 272.6, 166/272.7, 245

(56) References Cited

U.S. PATENT DOCUMENTS 4,088,190 * 5/1978 Fischer et al. ..... 166/403
4,344,485 * 8/1982 Butler ..... 166/271
4,501,326 * 2/1985 Edmunds ..... 166/272.3
4,598,770 * 7/1986 Shu et al. ..... 166/245
4,682,652 * 7/1987 Huang et al. ..... 166/263
4,696,345 * 9/1987 Hsueh ..... 166/245
4,889,186 * 12/1989 Hanson et al. ..... 166/252.1
5,016,710 * 5/1991 Renard et al. ..... 166/245
5,054,551 * 10/1991 Duerksen ..... 166/272.3
5,065,821 * 11/1991 Huang et al. ..... 166/245
5,520,247 * 5/1996 Gmelig Meyling et al. ..... 166/245
5,607,016 * 3/1997 Butler ..... 166/263
5,626,191 * 5/1997 Greaves et al. ..... 166/245

* cited by examiner

*Primary Examiner*—David Bagnell
*Assistant Examiner*—Jennifer R Dougherty
(74) *Attorney, Agent, or Firm*—Sheridan Ross P.C.

(57) ABSTRACT

In an underground oil reservoir, an injection well is completed low in the reservoir and a production well is provided having a horizontal leg completed relatively high in the reservoir and a vertical leg completed low in the reservoir. Water is injected with the vertical leg open and the horizontal leg closed, so that a displacement front advances in an under-riding manner between the wells and oil is produced through the vertical leg. Once the water break-through in the vertical leg occurs, it is closed and the horizontal leg is opened. A rising, horizontal, gravity-stable displacement front then advances upwardly toward the horizontal leg, through which oil is produced. The open horizontal leg acts as a low pressure sink to induce the horizontal displacement front to advance up toward it. This two-stage process is characterized by a good vertical and lateral sweep. In a slightly modified version, water is injected with the vertical leg closed and the horizontal leg open so that a gravity-stable displacement front advances both laterally and vertically with a relatively upright position of a displacement front. In this version (one stage process) the process is also characterized by a good vertical and lateral sweep.

5 Claims, 6 Drawing Sheets

117
117
115
108
107
115
106
108
107
105
102
100
OIL
WATER 117
117
115
108
107
115
106
108
107
105
102
100
OIL
WATER
109

TOE-TO-HEEL OIL RECOVERY PROCESS

FIELD OF THE INVENTION

The invention relates to guiding the advance of a liquid displacement front by means of a production well having an open horizontal leg oriented toward the injection well, which acts as a linear pressure sink to which the front is attracted and by which it is guided, and to an oil recovery process utilizing this mechanism.

BACKGROUND OF THE INVENTION

Waterflooding of underground oil-bearing reservoirs is the most common secondary oil recovery process utilized. In some cases, for example in off-shore reservoirs drilled from platforms, water is injected continuously from the start of oil production, for the purposes of maintaining the high production rates necessary to off-set the high production costs and to extend field life.

In general, the usual technique involves providing spaced-apart vertical injection and production wells completed in a reservoir. Typically, an injection well will be located within a pattern and a displacement front is advanced outwardly toward the surrounding production wells. Or alternatively, a row of injection wells may feed the injection fluid to a laterally extending displacement front which advances as a line drive toward a parallel row of production wells. The arrangement of wells can be either in a direct or staggered line drive, but the staggered line drive is preferred. In both cases, the operator seeks to establish an upright displacement front which provides good vertical sweep and advances generally horizontally through the reservoir with good lateral sweep.

However, the process is characterized by major difficulties. Even in a perfectly homogeneous reservoir rock, the phenomenon of gravity segregation causes the advancing water displacement front to slump because water typically has a higher specific gravity than the oil it is displacing. The result is a poor volumetric sweep efficiency and a low oil recovery as oil in the upper part of the reservoir is left behind. This "under-riding" problem is compounded when the reservoir permeability is greatest in the lower reaches. The geological reservoir sand property of "fining upwards" is quite common and is a form of heterogeneity that aggravates to the described water underflow.

A partial solution to this problem can be achieved by adding to the injected fluid a viscosifying agent, such as Xanthan[1] or polyacrylamide polymer, in order to reduce the mobility of the water. These agents tend to retard the advance of the injected fluid front through the more permeable streaks and/or lower layer sections. However, this solution, while it can be somewhat effective, seems to be relatively expensive and demanding from the operational point of view, and is not extensively practised. The problem of poor injectivity of viscous solutions of polymer, shear instability, and bacterial degradation have been barriers to polymer use.

[1] trade mark

One approach employed for waterflooding or chemical flooding oil reservoirs is the use of parallel horizontal wells alternating as injectors and oil producers. This approach provides high rates of fluid injectivity and oil production, but it is expensive since each horizontal well can cost millions of dollars. Problematically, once water breaks through in the production wells, the water rates rise quickly beyond the economical limit. The problems of water under-riding and poor volumetric sweep are not overcome by this well configuration.

It would therefore be desirable to re-engineer the flood technique so as to better control the way in which the injected liquid fluids such as water, brine, or chemical flooding fluids flow in the reservoir as the displacement front advances, so as to increase the volumetric sweep efficiency. The work underlying the present invention was undertaken to reach this objective.

A prior art process relevant to the present invention is disclosed in U.S. Pat. No. 5,626,191, issued to the same assignee as the present case. This process involves providing an injection well, completed high in the reservoir, and a production well having a horizontal leg completed low in the reservoir. The horizontal leg is oriented toward the injection well with its toe close to the injection well. In a preferred embodiment, in-situ combustion is initiated at the injection well and a laterally extending, upright combustion front is advanced toward the horizontal production well. The latter is kept open, to create a linear low pressure sink. The sink acts to attract and guide the advance of the laterally extending front along its length. It has been found that the combustion front will stay generally upright and its direction of advance is controlled to yield good vertical and lateral sweep.

The processes of the patent and the present case share the notion of using an open horizontal well to create a linear low pressure sink for guiding an oil displacement front. However they differ in other important respects which lead to different results, It will be noted that the patent is concerned with gaseous injectants and depends on the phenomenon of gravity drainage and a special special viscosity distribution, which is induced by a differential heating of the oil across the formation pay. The present invention differs in being based on a liquid injectant, different well completions and different procedures to achieve different results.

SUMMARY OF THE INVENTION

In accordance with one embodiment of the present invention it has been determined that:

- if an injection well (usually vertical) is completed low in an oil-containing reservoir and a production well, having a horizontal leg, is completed relatively high in the reservoir, the horizontal leg being oriented toward the injection well so that the leg lies in the path of a displacement front emanating from the injection well; and
- if a generally linear, laterally extending and upright water displacement front is established and propagated in the reservoir;
- then the horizontal leg, which is at low pressure (normally achieved by keeping the production well open), provides a low pressure sink and outlet that functions to induce the front to advance in a guided manner, first toward the "toe" and then along the length of the leg to the "heel";
- under these circumstances, the front has been found to remain generally stable and relatively upright and is characterized by good sweep efficiency; and
- additionally, as newly injected water flows through the water-invaded zone of the reservoir and through the relatively upright displacement front, the streamlines bend upwards toward the horizontal leg due to the upward flow gradient created by the action of the low pressure sink. Displaced oil tends to keep the bore of the horizontal leg full of oil, so that little water is produced through the production well until the water front has advanced along a substantial portion of the length of the horizontal leg.

This embodiment is referred to as the single-stage version of the invention. When tested, it demonstrated that a liquid fluid injectant that is heavier than the oil in place (such as water, brine or heavy brine containing a high content of dissolved salts or the like) will rise or advance upwardly in the form of a displacement front from a starting point low in the reservoir, if a linear, low pressure sink and outlet is provided high in the reservoir. In doing so, the front displaces oil ahead of it with a desirable degree of sweep and efficiency.

A second embodiment, referred to as the two-stage process, has also been developed and demonstrated. This process provides additional benefits of greater reservoir sweep, mainly in reservoirs with highest permeability in the lower reaches of the reservoir and which contain high viscosity oil.

According to the two-stage embodiment:

a well configuration is provided comprising an injection well completed low in the reservoir and production well means comprising a vertical leg completed low in the reservoir and a horizontal leg completed relatively high in the reservoir. The production well means may be a single well having two legs or two wells, one vertical and one horizontal;

in the first stage, the horizontal leg is shut in and the vertical leg is open, providing a low pressure sink low in the reservoir. A liquid injectant, heavier than the oil, is injected through the injection well. A fluid displacement front is therefore formed low in the reservoir. This front advances or is propagated in a pronounced underriding mode, toward the vertical leg of the production well;

when the front reaches or is about to reach the vertical leg, the second stage is initiated by opening the horizontal leg, to receive oil production, closing the vertical leg and continuing to inject fluid through the injection well;

under these circumstances, the horizontal production well provides a low pressure sink and outlet that functions to induce the fluid to advance in a guided and controlled fashion upwardly toward the upper reaches of the reservoir in a displacement front parallel to and moving towards the horizontal leg—the front has been found to remain generally stable and horizontal and is characterized by a relatively high sweep efficiency.

When compared with experimental runs with a conventional procedure wherein spaced-apart, simulated vertical fluid injection and production wells were completed in the same horizontal plane of the reservoir and a displacement front was initiated and propagated, the present process was found to be relatively characterized by:

increased vertical sweep efficiency, and increased recovery percentage of the oil in place.

Broadly stated, the invention is directed to a process for recovering oil from an underground oil-containing reservoir, comprising: providing an injection well completed in the lower part of the reservoir and a production well having a generally horizontal leg completed relatively high in the reservoir and oriented toward the injection well; injecting a liquid fluid, heavier than the oil into the reservoir through the injection well to establish a water-saturated zone low in the reservoir and underlying the horizontal leg; continuing to inject fluid with the production well open, so that oil may be produced through the horizontal leg which creates a low pressure sink which causes the enlarging fluid body to form a displacement front to advance upwardly through the reservoir toward the horizontal leg, thereby driving oil to the horizontal leg; and producing the driven oil through the horizontal leg of the production well.

DESCRIPTION OF THE PREFERRED EMBODIMENT

The invention was discovered in the course of carrying out an experimental investigation involving test runs conducted in a test cell or three dimensional physical cell, named a Helle-Shaw model.

Figure 1:
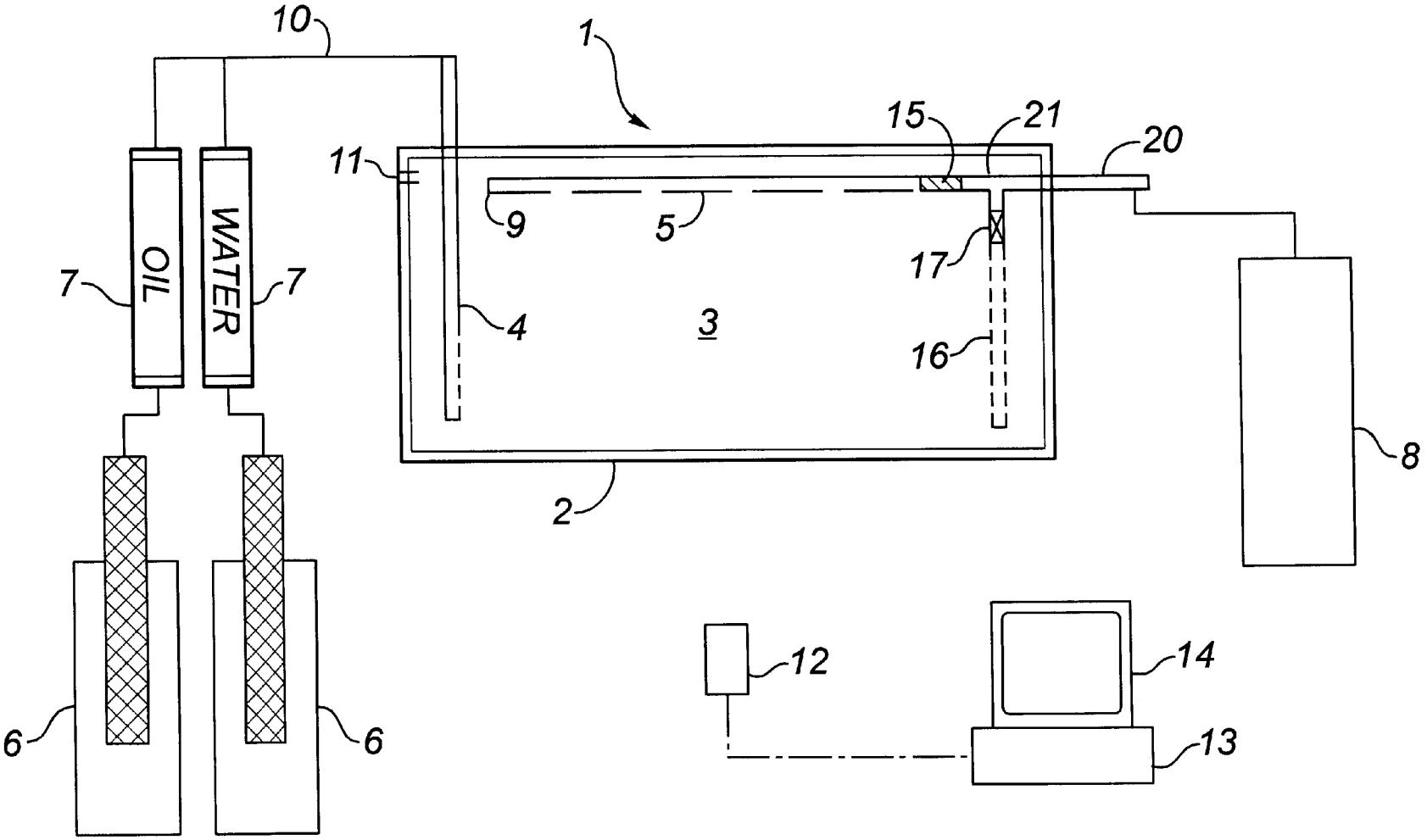
FIG. 1 is a schematic showing the experimental set-up used in the test runs reported in Table 1.
Figure 2A:
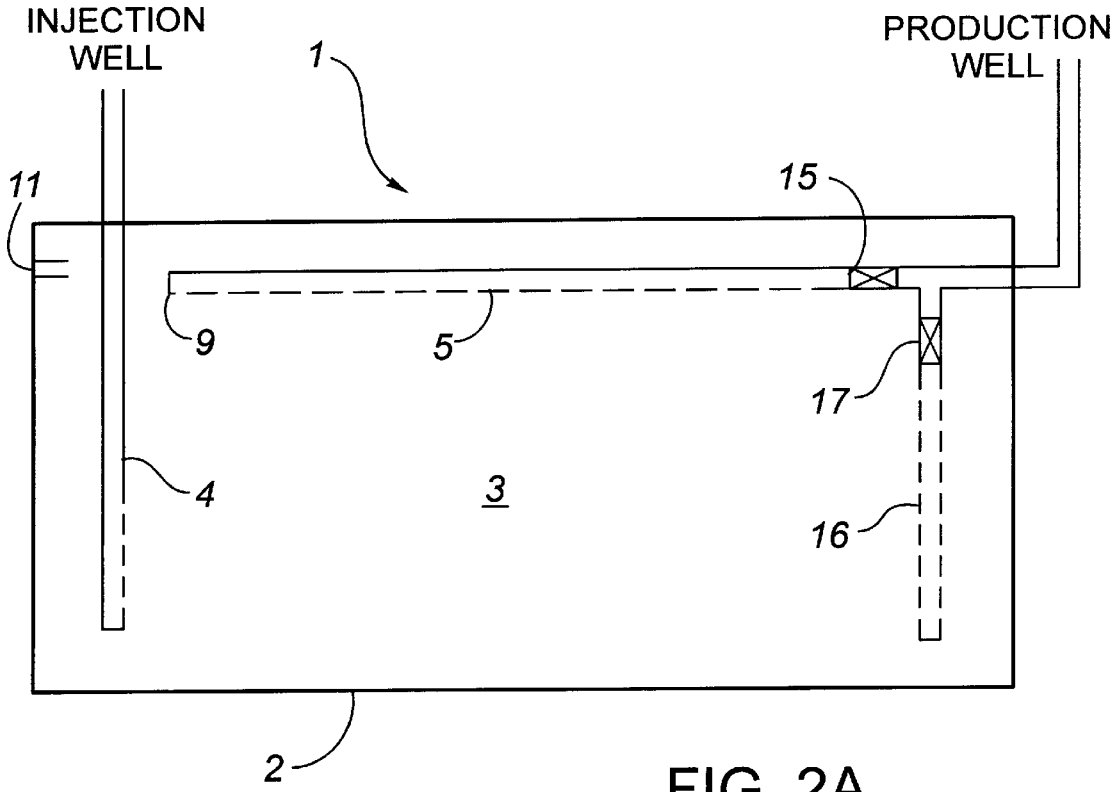
FIG. 2*a* is a side view of the Helle-Shaw test cell used in the experimental work—a simulated vertical injection well and a simulated production well having vertical and horizontal legs, are shown in the cell.
Figure 2B:
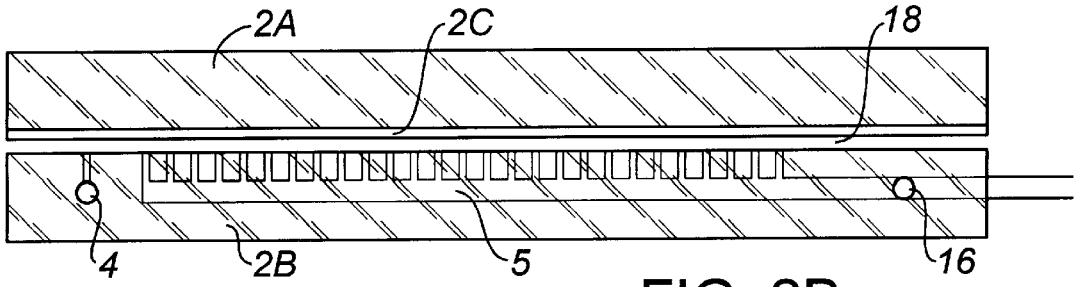
FIG. 2*b* is a top view of the test cell of FIG. 2*a;*

More particularly, a test cell 1, shown in FIGS. 1 and 2 was provided. The cell comprised a rectangular, closed box 2 made of Plexiglas[2] plates 2*a*, 2*b*. Box 2 formed a chamber 3 having an area of 12 inches by 23 inches. The plates 2*a*, 2*b* were transparent and they were held together by a series of long bolts (not shown) with a sealing gasket 2*c* (shown in FIG. 2) setting the plates 0.1 mm apart. This provided a permeability of the Helle-Shaw model of about 833 darcys. The thickness of the Plexiglas plates 2*a*, 2*b* was 2.5 inches. The vertical injection well 4 and production well vertical leg 16 and horizontal leg 5 were made of 5/16 inch tubing and they were drilled in the Plexiglas inner walls, being connected with the chamber 3 by a series of 1 cm spaced holes representing well perforations.

[2] trade mark

Chamber 3 was filled with oil. Two Ruska pumps 6 controlled the flow of liquids from storage cylinders 7 and delivered them through line 10 to the chamber 3. No backpressure was applied to the model production well; outlet 20 was at atmospheric pressure. The well 20 was connected with a receiver container 8.

A vacuum pump (not shown), placed at the bottom of the cell, enabled the filling and cleaning of the cell, using the auxiliary outlet 11.

A video camera 12, a VCR 13, a monitor 14, and a special set of lights (not shown) were used for a continuous recording of sharp images of the invaded zone throughout the testing Runs.

As indicated, a simulated vertical injection well 4 was provided at the injection end of the cell 3. A simulated production well horizontal leg 5 was provided in the upper end of chamber 3 and a production well vertical leg 16 was also provided at the opposite or production end of the cell. The injection well 4 was "perforated" relatively low in the chamber reservoir. The horizontal leg 5 was located and perforated relatively high in the chamber reservoir.

Provision was made to isolate the horizontal leg 5 and enable the vertical leg 16 to operate as a vertical producer, by using an insert 15 near the heel of the horizontal leg. Provision was also made to isolate the vertical leg or "pilot hole" by placing a sealing insert 17 into it. By then removing insert 15, the horizontal leg was opened up to produce oil. For all the Runs numbered 1*a* to l*e*, which represent prior art and are not part of the present invention, the sealing insert 15 was emplaced, thus isolating the horizontal leg. The vertical injector 4 was perforated over the bottom one third of its length and the vertical leg 16 of the production well was perforated through most of its length. The placement of the sealing inserts for each Run, whether in or out, is described below.

A 3% sodium chloride brine was used as the injection fluid in all the test Runs. Brine density was 1.02 g/cc and viscosity was 1.2 cps. All runs were at room temperature. The injection rate was set between 60 cc/hr and 2.5 cc/hr to control viscous fingering and permit good comparative tests in the same model.

Figure 3:
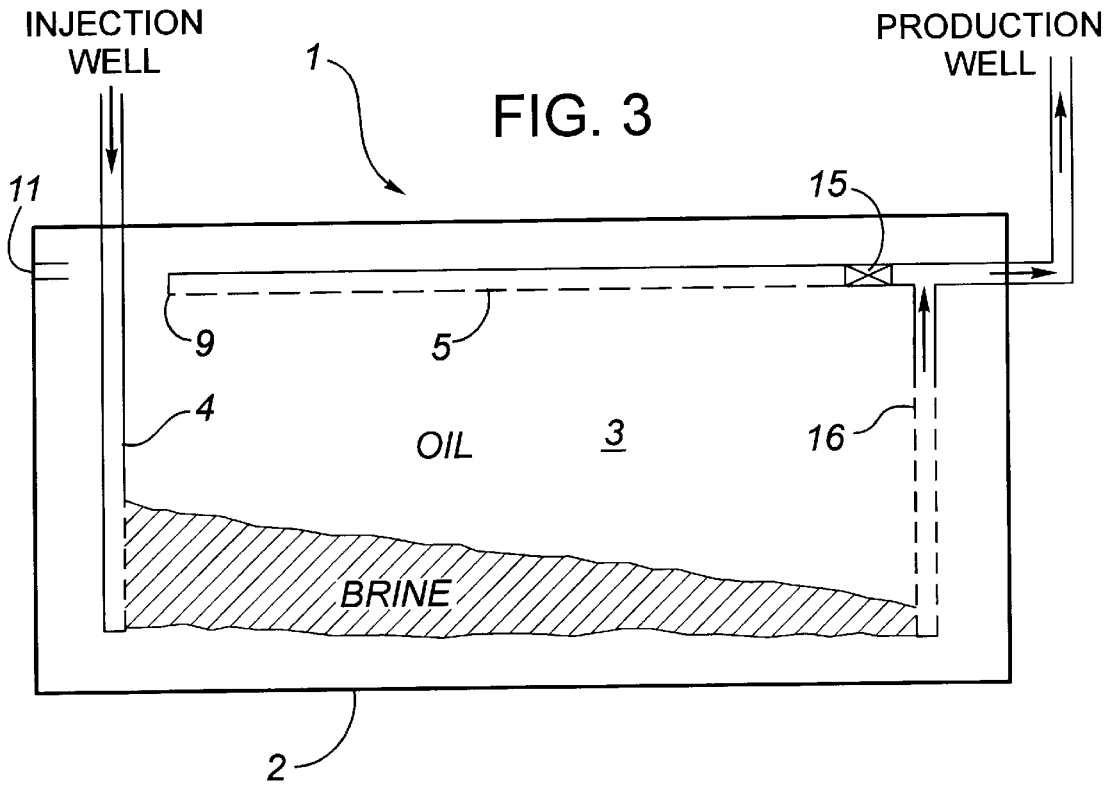
FIG. 3 is a schematic side view of the test cell showing the oil and water distribution as they appeared at the end of Run 1 *a* (a run carried out in accordance with the prior art)

FIG. 3 shows the pattern of the water displacement front in prior art Run 1*a* after displacing 10 cps oil in the Heel-Shaw cell: the flood had watered-out with oil recovery of 27%. These Runs are designated VI-VP, indicating vertical injector and vertical producer.

For all the Runs numbered 2*a* to 2*f*, carried out in accordance with the present invention, the single-stage version was employed. The vertical injection well 4 was used just as in the 1*a*–1*e* prior art Runs, but the insert 15 in the horizontal leg was removed and the sealing insert 17 was emplaced into the pilot hole 16. This oil recovery process is entitled "toe-to-heel waterflooding", and is designated as VI-HP, meaning vertical injector and horizontal producer in the Results of Test Runs, Table 1. The brine advanced in the reservoir both laterally and vertically. The horizontal leg 5 served as a low pressure sink which attracted the brine upwards, but this was offset by the counter effect of gravity segregation, which comes into effect because the brine has a higher specific gravity than the oil and causes slumping of the brine bank.

Figure 4A:
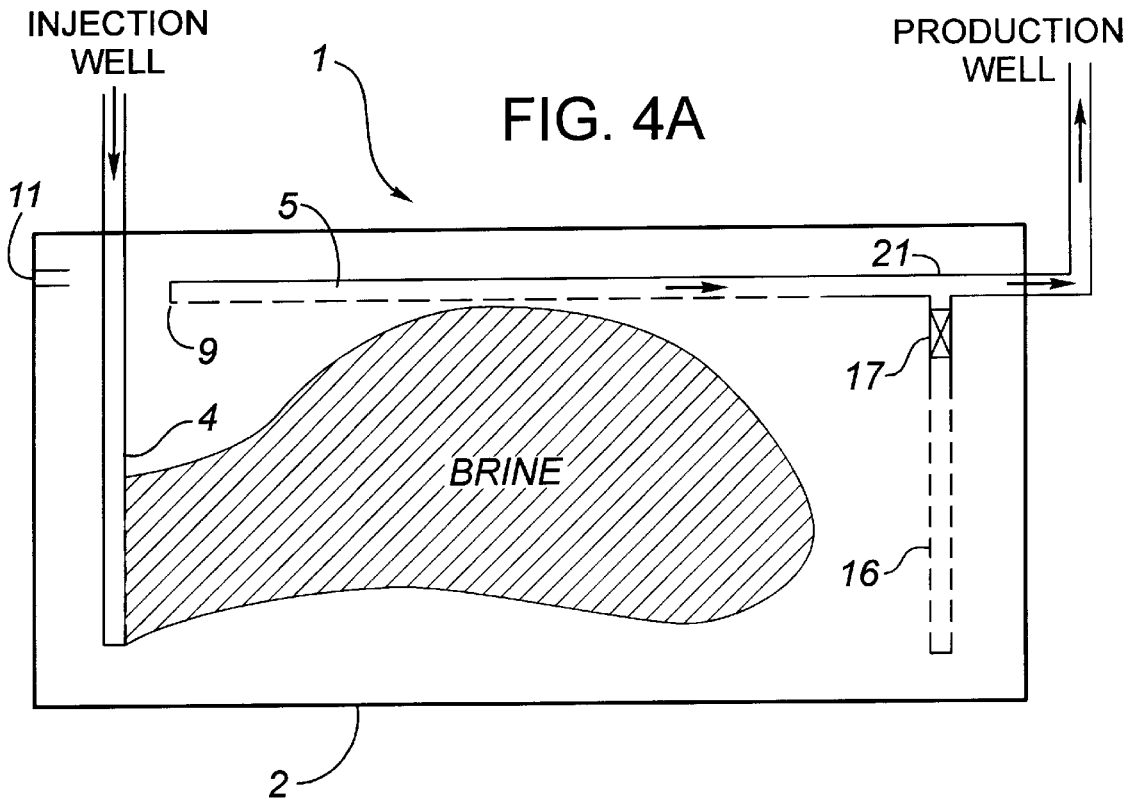
FIG. 4*a* is a schematic side view of the test cell showing the oil and water distribution as they appeared at water breakthrough for Run 2*a;*

Also, the toe-to-heel process provided favorable pressure distribution in the reservoir. The point of highest pressure in the horizontal leg was at the toe 9 and this was the closest point to the highest pressure point in the brine zone, which was the point of brine injection. The lowest pressure points in the horizontal leg 5 and the brine zone were likewise in relative proximity; these were the heel 21 of the horizontal leg and the furthest advance point in the brine zone, marked as X (FIG. 4*a*). The result of these favorable pressure relationships was to promote an even rise in the oil-brine interface, a delay in brine breakthrough and a high oil recovery efficiency relative to the prior art.

The toe-to-heel waterflooding process just described advantageously exploits both gravity and pressure relationships within the reservoir to provide superior oil recovery. In order to further promote the exploitation of gravity, a brine of higher density can be employed advantageously. The tendency of brine to resist vertical movement in the reservoir is increased by its greater density compared to the reservoir oil. One should select the brine of highest density when implementing the waterflooding processes of the present invention. Granted, such high density brines are not always available economically, but often there are naturally-occurring sources nearby. In Canada, for example, there are many sources of high-density brines. In Saskatchewan the Deadwood reservoir contains brine with density of 1.17 g/cc in proximity to heavy oil reservoirs. In central and northern Alberta all the reservoirs contain brines with high levels of total dissolved solids, typically in the range of 20% to 30% by weight. In fact, in the traditional process, waterflooding between vertical wells is less effective when employing high density brines because the injected brine slumps as it progresses in the reservoir, which reduces the reservoir aerial sweep and the oil recovery factor. In the processes of the present invention, the detrimental effect of brine density was turned into an advantage.

Figure 4B:
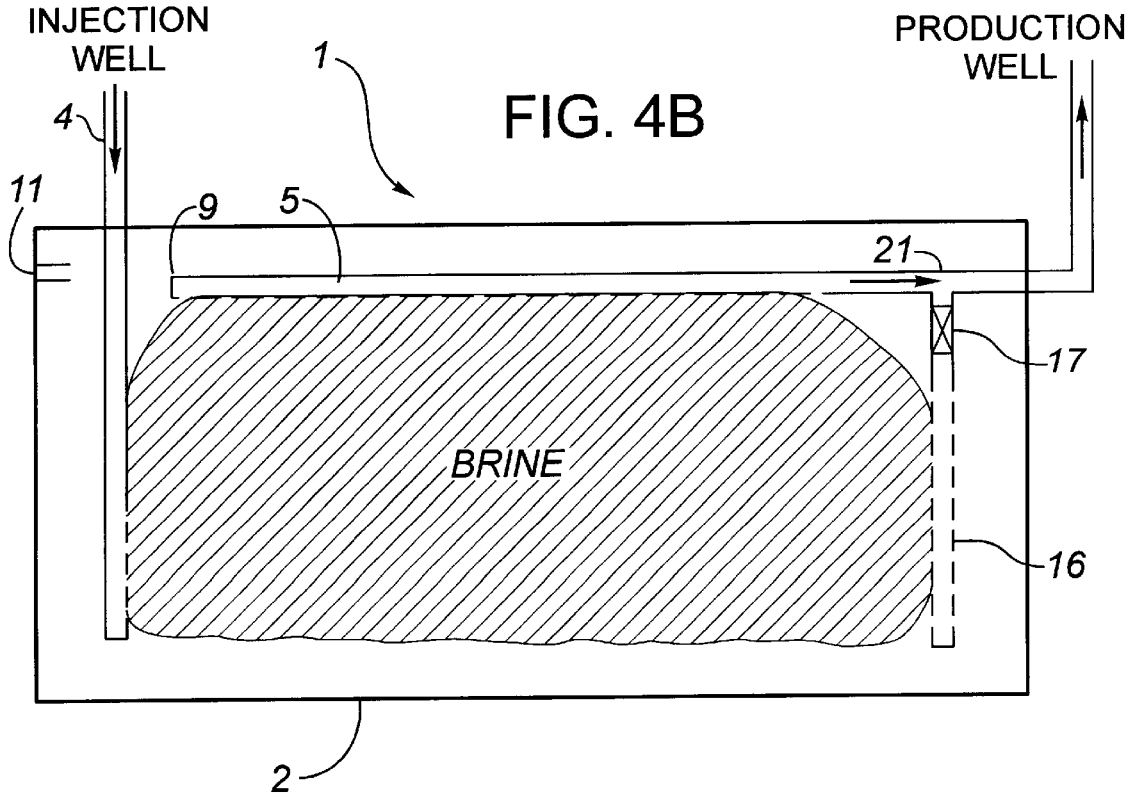
FIG. 4*b* is a schematic side view of the test cell showing the oil and water distribution as they appeared at the conclusion of Run 2*a;*

FIG. 4*b* shows the results for Run 2*a* of this process after the horizontal leg had watered-out with 84% oil recovery.

For all the Runs numbered 3*a* to 3*e*, which also constitute part of the present invention, the two-stage process was employed. Brine was first injected (as in the prior art Runs 1*a* to 1*e* described above) until the vertical pilot hole producer had watered out. This procedure was carried out in order to deliberately promote the under-riding mode of propagation of injected brine.

The poor vertical sweep achieved in this first stage is a normal result. The purpose was not to recover a lot of oil but to achieve a "blanket" of brine at the base of the reservoir, which would serve as a widespread brine source for the second stage of the process, which will now be described.

The second stage of the two-stage process involved the application of a vertical upward waterflooding process. The pilot hole 16 was shut in by the emplacement of the sealing insert 17 and the horizontal leg 5 was opened up by removal of sealing insert 15. Brine injection continued from injection well 4 and the horizontal oil-brine interface, which was established in stage 1, now rose vertically towards the horizontal leg 5 while remaining substantially horizontal. Consequently high oil recoveries were achieved.

This two-stage process is most advantageous for the recovery of heavier oils in reservoirs with highest permeability at the bottom of the pay section, for which channeling and viscous fingering are typically more pronounced.

All test results from this two-stage process are designated VI-VI-HP, meaning vertical injector, vertical producer, horizontal producer in Table 1.

TABLE 1

RESULTS OF TEST RUNS

| Run Number | Reservoir Crude Oil Source | Oil Type | Oil Viscosity cps | Oil Density g/cc | Brine Injection rate ml/h | Well Configuration (see note 1) | % Oil Recovered at initial brine show | % Oil Recovered at watering out | Density Difference: brine-oil |
|---|---|---|---|---|---|---|---|---|---|
| 1a | Pembina | light | 10 | 0.8517 | 60 | VI-VP | 22 | 27 | 0.168 |
| 2a | Pembina | light | 10 | 0.8517 | 60 | VI-HP | 78 | 84 | 0.168 |
| 3a | Pembina | light | 10 | 0.8517 | 60 | VI-VP-HP | 78 | 90 | 0.168 |
| 1b | Dunsmore | medium | 112 | 0.918 | 20 | VI-VP | 23 | 27 | 0.101 |
| 2b | Dunsmore | medium | 112 | 0.9189 | 20 | VI-HP | 24 | 58 | 0.101 |
| 3b | Dunsmore | medium | 112 | 0.9189 | 20 | VI-VP-HP | 36 | 68 | 0.101 |
| 1c | Court | lt. heavy | 480 | 0.9451 | 10 | VI-VP | 14 | 23 | 0.075 |
| 2c | Court | lt. heavy | 480 | 0.9451 | 10 | VI-HP | 12 | 54 | 0.075 |
| 3c | Court | lt. heavy | 480 | 0.9451 | 10 | VI-VP-HP | 20 | 58 | 0.075 |
| 1d | Lindberg | heavy | 1200 | 0.9712 | 2.5 | VI-VP | 22 | 40 | 0.049 |
| 2d | Lindberg | heavy | 1200 | 0.9712 | 2.5 | VI-HP | 21 | 67 | 0.049 |
| 3d | Lindberg | heavy | 1200 | 0.9712 | 2.5 | VI-VP-HP | 44 | 70 | 0.049 |
| 2d* | Lindberg | heavy | 1343 | 0.9712 | 2.5 | VI-VP-HP | 17 | 73 | 0.201 |
| 1e | Pembina | light | 10 | 0.8517 | 20 | VI-VP | 27 | 46 | 0.168 |
| 2e | Pembina | light | 10 | 0.8517 | 20 | VI-HP | 93 | 96 | 0.168 |
| 3e | Pembina | light | 10 | 0.8517 | 20 | VI-VP-HP | 91 | 94 | 0.168 |
| 2f | Bodo | v. heavy | 12000 | 0.9881 | 2.5 | VI-HP | 14 | 32 | 0.184 |

Note:
VI = Vertical Injector
VP = Vertical Producer
HP = Horizontal Producer

A constant flooding rate was used for each type of oil. The results provided in Table 1 indicate the following:

Waterflooding of light oil of 10 cps viscosity, in Runs 2*a* and 3*a* of the present invention, gave more than three times the oil as the prior art Run 1*a;*

Waterflooding of medium oil of 110 cps viscosity, in Runs 2*b* and 3*b* of the present invention, gave more than two times as much oil recovery as the prior art Run 1*b;* waterflooding of light-heavy oil of 480 cps viscosity, in Runs 2*c* and 3*c* of the present invention, gave more than two times the oil recovery as the prior art Run 1*c;*

Waterflooding of heavy oil of 1200 cps viscosity, in Runs 2*d* and 3*d* of the present invention, gave an improvement of more than 67% in the oil recovery as compared with the prior art Run 1*d.*

In order to test the effect of specific gravity of the injected brine on oil recovery, additional Runs 2*d and 2***f* were conducted. A high-density brine of 23 weight percent sodium chloride of density 1.172 g/cc was used for these Runs. For Run 2*d the high density brine produced 7.5% more oil than the comparable low density brine Run 2***d* (73% recovery).

The concept of maximizing oil/brine gravity segregation by employing high density brines was further tested in Run 2*f* where the oil was 12,000 cps Bodo crude oil. Waterflooding such a viscous oil with prior art processes would normally not be considered because of the likelihood of extreme viscous fingering. So ar, commercial and semi-commercial applications of waterflooding have been conducted for oils having viscosities less than 1,000–2,000 cp. Using the one-stage toe-to-heel waterflooding process of the present invention with high density brine gave a very high oil recovery of 32%.

Clearly, the use of an injectant brine of higher density would be preferred for heavy oil recovery when using the gravity toe-to-heel processes. For example, a brine of density 1.17 g/cc, which is available from the Deadwood reservoir in Saskatchewan, Canada, has a density difference of 0.201 g/cc compared with Lindbergh heavy oil in Run 2*d. This is greater than the density difference of 0.168 g/cc in the light oil Runs, which showed excellent oil recovery advantage for the present invention. In the case of the very heavy Bodo oil, the density difference was 0.184 g/cc in Run 2***f*.

By way of information, the entire Devonian formation in Alberta and Saskatchewan contains high salinity brines, having total dissolved solids typically in the 200,000 ppm to 300,000 ppm range.

One concern that oil production engineers have in heavy oil waterflooding is the restricted iniectivity caused by the poor mobility of heavy oil. Poor injectivity will limit productivity, however the two-stage process can help overcome injectivity problems. Besides providing the highest total oil recovery, the two-stage waterflooding process of the present invention will provide relatively high injectivity during the second stage because the broad blanket of the water zone created in the first stage forms a high water mobility zone in the reservoir and a large interfacial area between the oil and water zones. Besides, the oil is displaced and moved on the shortest distance between its place of occurrence and the closest point on the horizontal leg. These two phenomena provide for a slow vertical advance rate of the brine against the oil and reduces viscous fingering and at the same time reduces necessary pressure drop, so that the injectivity is increased. This will enhance the oil production rate and increase recoverable oil.

Viscous fingering is also reduced by "gravity healing", which is the tendency for the high density brine to phase segregate from oil under gravitational forces towards the lower part of the reservoir. This effect was observed in Run 2*f* where the water zone slumped over several days following termination of the Run and fell away completely from the horizontal production well and into the center of the model. In the field, advantage of this benefit could be realized by shutting-in watered-out horizontal producer wells, and then re-starting after an appropriate period of time.

A striking advantage of both the gravity-stable toe-to-heel processes is the large amount of oil recovered after the initial water production. The gravity unstable prior art process tended to water-out more quickly after the water breakthrough.

An alternative to the vertical-well-to-vertical-well waterflooding operation, which constitutes the first stage of the two-stage process of the present invention, is the use of horizontal fracturing technologies in order to rapidly and effectively establish a broad water zone at the base of the reservoir. If the reservoir is shallow, as is frequently the case for heavy oil deposits, the fracture will propagate horizontally. The continuous high injection of brine into the disk-shaped fracture will keep the fracture open and provide a broad water/oil interface, just as desired in the two-stage waterflooding process described in the present invention.

The preferred well patterns or configurations for field applications of the present invention will be illustrated for the case of waterflooding using either the single-stage process or the two-stage process.

Waterflooding using the two-stage process will be illustrated using a row of wells to initiate the process. In the two-stage preferred oilfield embodiment of the proposal, illustrated in FIGS. 5 and 7, a reservoir 100 is characterized by an upward dip and lateral strike. A row 101 of vertical water injection wells 102 located along the strike, is completed and has perforations at the lower part of the oil formation (pay thickness) of the reservoir 100. At least two rows 103, 104 of production wells 105, 106, having generally horizontal legs 107, are completed high in the reservoir and up-dip from the injection wells, with their toes 108 closest to the injection wells 102. The toes 108 of the row 103 of production wells 105 are spaced up-dip from a vertical projection of the injection wells 102. The second row 104 of production wells 106 is spaced up-dip from the first row 103. Generally, the distance between wells, within a row, is substantially lower than the distance between adjacent rows, All the production wells are provided with a vertical pilot hole, which is initially open while the horizontal leg is initially closed to oil production. Inflatable packers, 115 and 117, may be used to close the pilot hole or horizontal well respectively.

In the first phase of the preferred process, a narrow water zone (water tongue) is generated in the reservoir 100 by injecting water through every second well 102. Preferably a narrow water front is developed at the bottom of formation 100 by initiating water injection at every second well and advancing these fronts laterally through the bottom of the oil reservoir until the other wells in Row 101 are intercepted by the water front in order to recover the oil between the wells 102. During this process the pilot holes and the horizontal legs of wells 105 are closed. Then, the pilot holes of wells 105 are opened while the horizontal legs 107 remain closed as water is injected through all the wells 102 in order to feed a single narrow front, which advances at the bottom of the reservoir 100 up-dip towards the pilot holes of wells 105. The pilot holes of production wells 105 are open during this step, to induce the front to advance through the lowest layer towards the pilot wells and to provide an outlet for the oil. When the oil displacement front reaches the pilot holes of production wells 105 and the wells water-out, then pilot holes 105 are closed and the horizontal legs 107 of wells 105 are opened to receive oil production while water injection continues at injection wells 102. The completed waterflooding from injection wells 102 to production wells 105 creates a blanket of water across the bottom of the reservoir 100. The opening of the horizontal legs 107 of production wells 105 creates a low pressure sink to induce the water/oil interface to advance vertically, upwards, towards their horizontal legs 107 and to provide an outlet for the oil. When no more oil is produced and the horizontal legs 107 water-out, the horizontal legs are no longer needed and are closed off. The pilot holes of wells 105, which are already perforated in the lower part of the reservoir 100, are converted to water injection, thereby continuing the propagation of a water front toward the second row 104 of production wells. This process is repeated as the water front progresses through the various rows of production wells.

Figure 5:
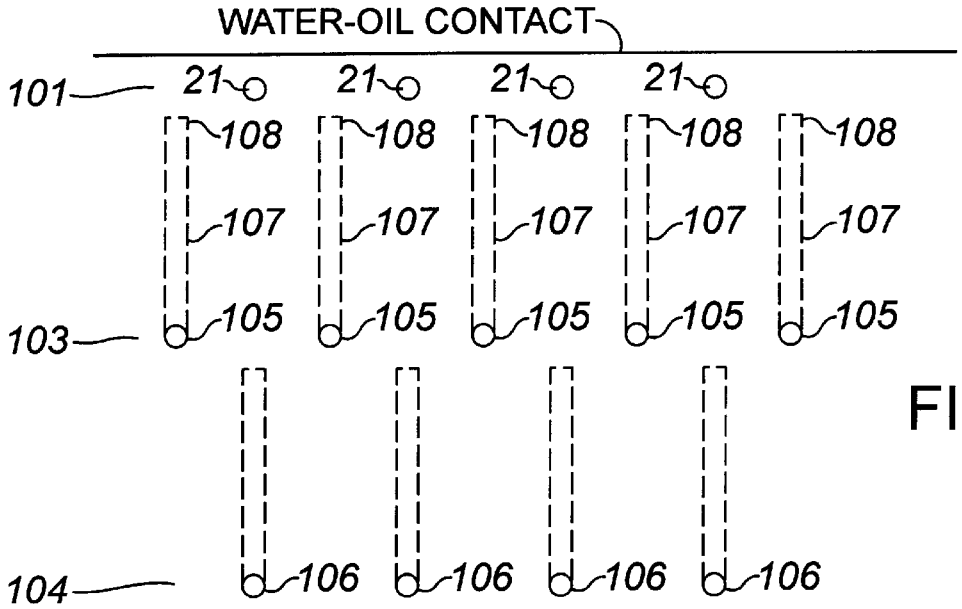
FIG. 5 is a schematic plan view showing one proposed well pattern arrangement for utilizing the invention, wherein vertical injectors are used to initiate the displacement process.
Figure 7:
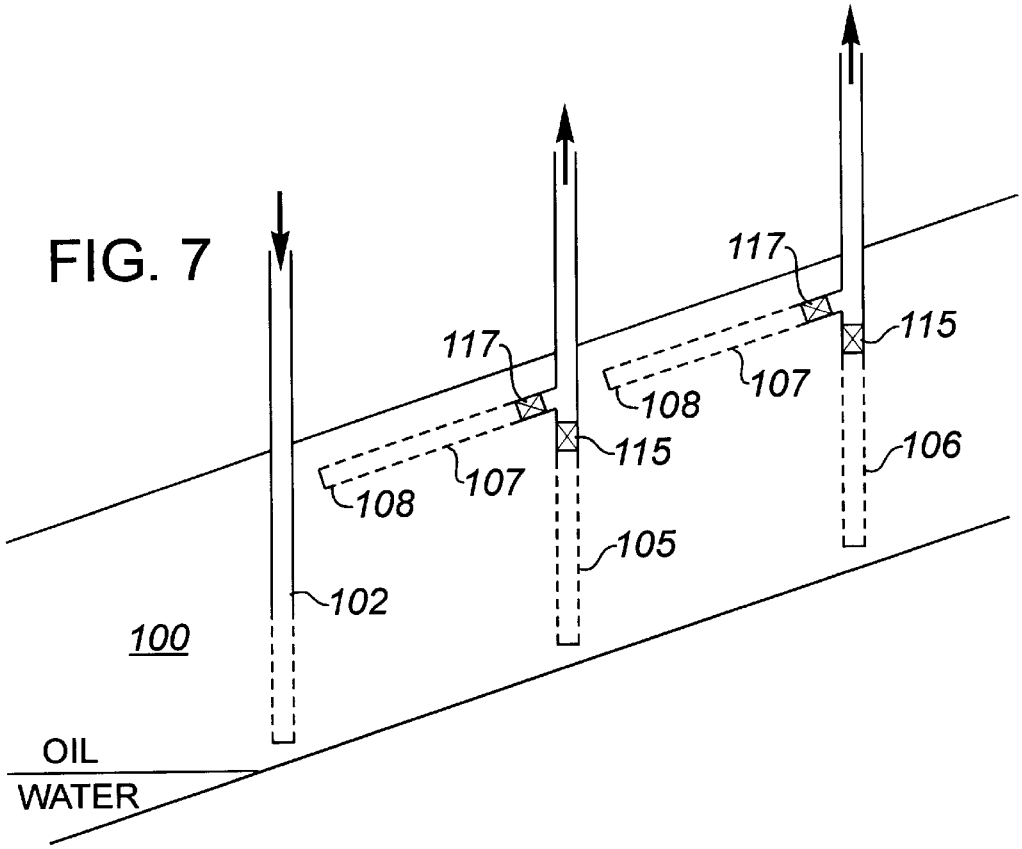
FIG. 7 is a perspective view of part of the well arrangement of FIG. 5.

A preferred field embodiment of the preferred one-stage oilfield waterflooding process will now be described in connection with FIGS. 5 and 7. The recovery of oil between the vertical wells 102 is conducted as described above for the two-stage process, however, the step of creating a water blanket at the bottom of the reservoir, in the space between vertical injectors and horizontal producers, is omitted. Water is injected at all wells 102 and oil is produced immediately at the horizontal legs of wells 105, while the pilot holes are closed. The water front advances laterally towards the closed wells and also vertically towards the low pressure sink created by the horizontal legs of wells 105. The forces of gravity segregation of the higher density water phase towards the lower part of the reservoir and the attraction of the low pressure sink located in the upper reaches of the reservoir serve to provide excellent reservoir sweep and high oil recovery. Finally, when no more oil is produced and the horizontal legs of the wells 107 water-out, the horizontal legs are closed off and the pilot holes 105 are perforated in the lower part of the reservoir 100, being utilized for water injection, thereby continuing the propagation of the water front toward the second row of production wells. This process is repeated for each row of production wells.

Figure 6:
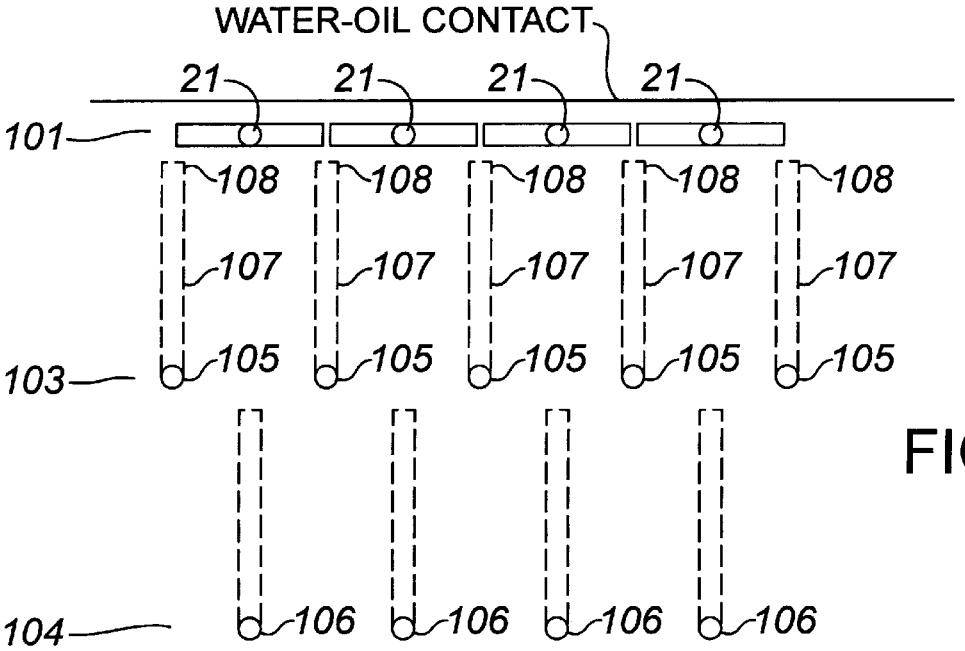
FIG. 6 is a schematic plan view showing another proposed well pattern arrangement for utilizing the invention, wherein dual opposing horizontal wells are used as injectors to initiate the displacement process.
Figure 8:
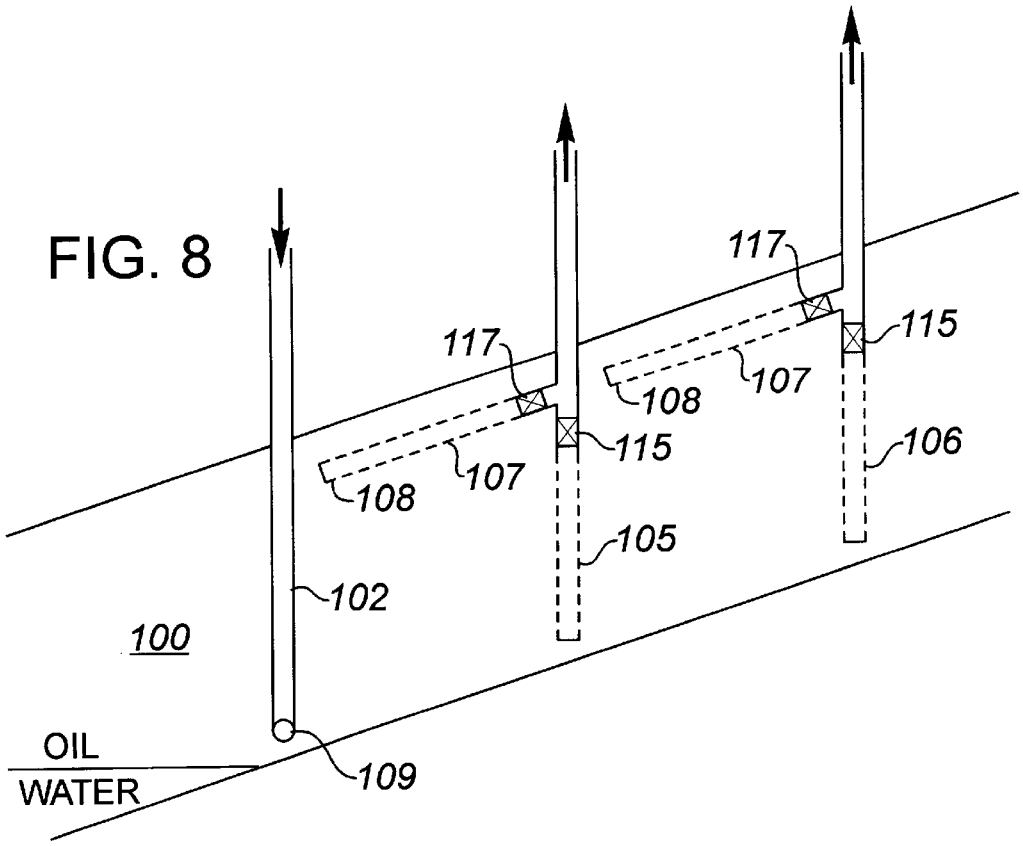
FIG. 8 is a perspective view of part of the well arrangement of FIG. 6.

In both the one-stage and two-stage processes, row 101 of vertical injector wells may be replaced by a set of collinear multilateral horizontal wells drilled low in the reservoir, at the base of vertical wells 102 as illustrated in FIGS. 6 and 8. Alternatively, wells 102 can be replaced by a single extended horizontal well set low in the reservoir, offset from but adjacent to the toe of the horizontal wells 107.

As a further enhancement of the process, the injected water may contain chemicals which reduce oil/water interfacial tension. Such chemicals are well known in the prior art for enhanced oil recovery and include alkaline chemicals such as sodium hydroxide, sodium carbonate, sodium bicarbonate and silicates, as well as surfactants. These chemicals can be used individually or in combinations and serve to increase microscopic displacement to provide higher oil recovery. Brines of high density may be chosen to improve the gravity stability of the process. Polymers may be added to take advantage of synergistic interactions with the surfactants and oil.

The embodiments of the invention in which an exclusive property or privilege is claimed are defined as follows:

1. A process for recovering oil from an underground oil-containing reservoir, comprising:

providing an injection well completed in the lower part of the reservoir and a production well having a generally horizontal leg completed relatively high in the reservoir and oriented toward the injection well;

injecting a liquid fluid, heavier than the oil, into the reservoir through the injection well to establish a body of said fluid low in the reservoir and underlying the horizontal leg;

continuing to inject fluid with the production well open, so that oil may be produced through the horizontal leg and the leg creates a low pressure sink which causes a displacement front to advance laterally and/or upwardly through the reservoir toward the horizontal leg, thereby driving oil to the horizontal leg; and producing the driven oil through the horizontal leg of the production well.

2. The process as set forth in claim 1, wherein:

the injected liquid fluid is selected from the group consisting of water and brine.

3. The process as set forth in claim 1, wherein:

a plurality of injection wells, arranged in a row, is provided;

a plurality of production wells, arranged in a row parallel to the injection row, is provided with the toes of the horizontal legs close to but spaced from the injection wells;

the displacement fronts formed are of the line drive type; and the injected fluid is water or brine.

4. A process for recovering oil from an underground oil-containing reservoir, comprising:

providing an injection well completed in the lower part of the reservoir and a production well having a generally horizontal leg completed relatively high in the reservoir and oriented toward the injection well;

injecting a liquid fluid, heavier than the oil, into the reservoir through the injection well with the production well open so that oil may be produced through the horizontal leg and the leg creates a low pressure sink which causes the injected fluid to form a displacement front advancing through the reservoir along the direction of the horizontal leg and upwardly toward it, thereby driving oil to the horizontal leg; and producing the driven oil through the production well.

5. A process for recovering oil from an underground oil-containing reservoir, comprising:

providing an injection well completed in the lower part of the reservoir and a production well means having a generally vertical leg completed in the lower part of the reservoir and a generally horizontal leg completed relatively high in the reservoir and oriented toward the injection well;

injecting a liquid fluid, heavier than the oil, into the reservoir through the injection well with the vertical leg open and the horizontal leg closed, so that the injected fluid forms a displacement front advancing forwardly through the lower part of the reservoir toward the vertical leg, to establish a layer of fluid underlying the horizontal leg, and oil is produced through the vertical leg; and then opening the horizontal leg, closing the vertical leg and continuing to inject fluid through the injection well so that a displacement front advances upwardly toward the horizontal leg and oil is produced through the horizontal leg.

* * * * *